US007108611B2

(12) United States Patent
MacIlraith

(10) Patent No.: US 7,108,611 B2
(45) Date of Patent: Sep. 19, 2006

(54) INDIVIDUALLY CUSTOMIZED GOLF CLUB AND PROCESS

(76) Inventor: Steve MacIlraith, 18190 Lake Forest Dr., Penn Valley, CA (US) 95946

( * ) Notice: Subject to any disclaimer, the term of this patent is extended or adjusted under 35 U.S.C. 154(b) by 0 days.

(21) Appl. No.: 10/741,311

(22) Filed: Dec. 18, 2003

(65) Prior Publication Data

US 2004/0132541 A1 Jul. 8, 2004

Related U.S. Application Data

(60) Provisional application No. 60/435,967, filed on Dec. 19, 2002.

(51) Int. Cl.
*A63B 53/04* (2006.01)
*A63B 53/06* (2006.01)

(52) U.S. Cl. ..... 473/288; 473/340; 473/334; 473/350; 473/337; 473/345

(58) Field of Classification Search ..... 473/324–350, 473/288–290, 219–256
See application file for complete search history.

(56) References Cited

U.S. PATENT DOCUMENTS 1,538,312 A * 5/1925 Beat ..... 473/335
1,582,836 A * 4/1926 Link
3,212,783 A * 10/1965 Bradley
3,368,812 A 2/1968 Baldwin
3,424,459 A 1/1969 Evahcho
3,516,674 A * 6/1970 Scarborough
3,524,646 A 8/1970 Wheeler
3,652,094 A * 3/1972 Glover ..... 473/337
3,829,092 A 8/1974 Arkin
3,848,737 A 11/1974 Kenon
3,891,212 A 6/1975 Hill
3,893,670 A 7/1975 Franchi
4,085,934 A * 4/1978 Churchward ..... 473/338
4,121,832 A * 10/1978 Ebbing ..... 473/335
4,253,666 A 3/1981 Murphy
4,340,227 A 7/1982 Dopkowski
4,540,178 A * 9/1985 Johnson et al. ..... 473/335
4,664,382 A 5/1987 Palmer et al.
4,869,507 A * 9/1989 Sahm ..... 473/337
4,883,274 A * 11/1989 Hsien ..... 473/335
5,275,413 A * 1/1994 Sprague ..... 473/337
5,297,794 A * 3/1994 Lu ..... 473/337
5,437,447 A * 8/1995 Rigutto ..... 473/251

(Continued)

*Primary Examiner*—Sebastiano Passaniti
(74) *Attorney, Agent, or Firm*—McDonough Holland & Allen PC

(57) ABSTRACT

A variable golf club head includes multiple skeletal faces each having a ball contacting surface, a point for shaft attachment, and an attachment surface typically opposite the ball contacting surface. In the construction of the variable golf club head, one skeletal face is selected from the multiplicity of skeletal faces provided. Each skeletal face away from the ball contacting surface is provided with an array of fastening points, the array varying with the particular skeletal face selected. Multiple head covering bodies are provided for each skeletal face to fasten over the backside of each skeletal face and extend away from the ball contacting surface. These head covering bodies impart to the variable golf club head appearance and aerodynamics. Each head covering body is typically capable of being fastened to a series of skeletal faces at selected fastening points. Various head weights are provided correspondingly varying in density, dimension, and shape for placement interior of the golf club head to the skeletal face away from the ball or to the covering body, or both.

19 Claims, 9 Drawing Sheets

U.S. PATENT DOCUMENTS 5,441,268 A * 8/1995 Shier ..... 473/236
5,509,660 A * 4/1996 Elmer ..... 473/288
5,547,427 A * 8/1996 Rigal et al. ..... 473/345
5,655,976 A * 8/1997 Rife ..... 473/340
5,924,938 A * 7/1999 Hines ..... 473/307
6,203,443 B1 * 3/2001 Britton ..... 473/244
6,471,604 B1 * 10/2002 Hocknell et al. ..... 473/334
6,485,375 B1 * 11/2002 McKinley ..... 473/245
6,641,487 B1 11/2003 Hamburger
6,659,883 B1 * 12/2003 Nelson et al. ..... 473/324

* cited by examiner

INDIVIDUALLY CUSTOMIZED GOLF CLUB AND PROCESS

CROSS-REFERENCES TO RELATED APPLICATIONS

This application claims priority from U.S. Provisional Patent Application Ser. No. 60/435,967, filed Dec. 19, 2002.

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK.

NOT APPLICABLE

This invention relates to golf clubs. More specifically, a golf club is disclosed which enables customizing the weight, appearance, feel, and performance of the golf club to each golfers unique needs, desires, and physiology.

BACKGROUND OF THE INVENTION

Each golfer is unique. Because of the infinite physical and mental variations of humanity, each golfer has his own unique individual physiology and individual psychology. These unique individual physiologies and individual psychologies produce a correspondingly unique individual golf swing. Unfortunately, the sale of golf clubs is not aimed at this uniqueness of every golfer's swing.

At this time, there are three general ways in which golf clubs are manufactured, marketed, and sold. A first group of manufacturers of golf clubs sell their clubs in the finished and assembled state. Marketing, and not the purchasing individual, has much to do with the sale and use of such golf clubs. A second group assembles golf clubs from their individual components including the grip, shaft, and club head components. Within the constraints of the manufactured components, this second group achieves a limited customizing of golf clubs. A third group designs clubs to match the "physics" of a golf club striking a golf ball. Unfortunately, golf and physics are not the same. Analysis of these generic manufacture, marketing, and sale of golf clubs to the average golfer establishes the fallacious theoretical foundation of these practices.

Regarding the sale of the golf clubs in the finished and assembled state, a short example of how such clubs are designed will suffice. Typically, a world famous professional golf athlete usually prefers a "professional's favorite club." This "professional's favorite club" is usually a customized golf club, tailor made to the professional and the product of numerous iterations to match the required needs of the professional golf athlete. It is a common practice to duplicate such clubs. Thereafter, by attaching the name of the professional golf athlete to the finished and assembled duplicate of his golf club, substantial sales are generated.

This practice defies logic and common sense. The professional golf athlete is usually a physically fit, mentally unique, full-time professional golfer. To compare this professional golf athlete to the randomly selected amateur who is of random build, typically unfit, mentally unsure, and a part-time opportunistic golfer is not logical. To further assume that golf clubs sold in the finished and assembled state can be transferred without consequence from the professional golf athlete to the randomly selected amateur defies logic.

Unfortunately, golf clubs sold in the finished and assembled state can never match the required weighting, appearance, feel, and performance which can be individually tailored to each golfer. This sale of clubs in their finished and assembled state assumes that the weighting, appearance, feel, and performance will be the same for the unique professional golfer and the randomly selected amateur. The mere statement of this proposition establishes its fallacious logic.

A second group of golf club manufacturers can be described as the component manufacturers group. They manufacture and or sell golf club components singularly. These components include the grip, the shaft, and the club head. Final assembly of the grip, shaft, and club head components is left to a group of golf club assemblers, who combine these golf club components. More often than not, the combination includes copies or imitations of the professional's favorite club at reduced prices. Thus, although the possibility of some individual customization of golf clubs is present, the opportunity is frequently forfeited in favor of the current "professional's favorite club" fad. Further, and once these golf clubs are assembled, club change seldom occurs. The purchasing golfer is constrained to the assembled golf club unit.

A third group of golf club manufacturers can be described as the vendors of "engineered" golf clubs. Characteristic of these clubs are unique grips, carbon fiber shafts, and engineered impact heads. Taking the case of the engineered impact heads, in one engineered golf club design, the mass of the golf club head is concentrated at the periphery of the club head while the center of the club is hollowed to reduce the centrally located mass of the club. This design takes into account the well-known engineering principle of "rotational moment of inertia." With such a club head, if the golf ball is hit off center, the tendency of the club to correspondingly drive the ball off center is reduced.

Unfortunately, for this "engineered" design, it is frequently forgotten that golf is a physical game governed by arbitrary rules which are not ergonomically matched to the arbitrary and random physiological and psychological state of the average human.

In golf, the player must place his feet on one side of the ball and swing a golf club eccentrically to his body on the other side of his feet to contact the ball on a random other than-level green. The golf ball is aimed at a hole having non uniform placement on a green with random and changing elevations with placed holes that are constantly changed. Further, the golf club (here are known as a "putter") is required to be asymmetric with respect to the human body. According to the rules of golf, the putter head at its bottom green contacting surface must be inclined with respect to the shaft at least 10 degrees. The putter at its face can be inclined upwardly up to 10 degrees away from the green. The shaft can have a 20 degree variation with respect to the putter head within the plane of swing of the putter. Further, attachment of the shaft to the putter head can vary within wide limits so long as the shaft fastens anywhere to the putter head. Ergonomically, considering the human body and the laws of physics, golf has arbitrary, random, and other than optimal characteristics which cannot be solved by "engineered" designs.

Compounding the way in which golf clubs are manufactured, marketed and sold is the propensity of the average golfer to change. During youth, strength, coordination and mental attitude rapidly and (usually) favorably change. At maturity, strength, coordination and mental attitude usually have some predictability but are nevertheless dynamic. Finally, with age, strength, coordination, and mental attitude again undergo (usually) unfavorable change. Yet in this latter "with age" case, golf is more frequently played by the dedicated player.

In this environment, the (average) golfer is encouraged to maintain a precisely repeatable swing and stroke for maximum accuracy and predictability of his game. The golf club is an integral part of the precisely repeatable swing and stroke. Unfortunately, and as set forth above, there has been no attempt to individually tailor golf clubs to the average golfer within the overall constraints set forth above.

BRIEF SUMMARY OF THE INVENTION

A variable golf club is provided. Multiple skeletal faces are provided each having a ball contacting surface, a point for shaft attachment, and an attachment surface typically opposite the ball contacting surface. In the construction of the variable golf club head, one skeletal face is selected from the multiplicity of skeletal faces provided. Each skeletal face away from the ball contacting surface is provided with an array of fastening points, the array varying with the particular skeletal face selected. Multiple head covering bodies are provided for each skeletal face to fasten over the backside of each skeletal face and extend away from the ball contacting surface. These head covering bodies impart to the variable golf club head appearance and aerodynamics. Each head covering body is typically capable of being fastened to a series of skeletal faces at selected fastening points. Various head weights are provided correspondingly varying in density, dimension, and shape. In the usual case, the head weights can be selectively applied to skeletal face opposite the ball contacting surface. Alternately, provision can be made for selected head weights fastening to the head covering body. The variable golf club head is fastened to a shaft at varying angles of attachment at the selected skeletal face. The shaft is provided with grips selected from a multiplicity of grips. In use, the method of club head assembly includes selecting a skeletal face and thereafter observing and selecting a head covering body from the available multiplicity of head covering bodies available for the selected skeletal face. Thereafter, weighting of the variable golf club head occurs either to the skeletal face or alternatively to the selected head covering body, or to both. Finally, the fitted golf club is semi permanently assembled in a manner wherein change of the club with the disclosed variable components during a round of golf is not possible. A golf club individually tailored to the average golfer results.

DETAILED DESCRIPTION OF THE INVENTION

Figure 1:
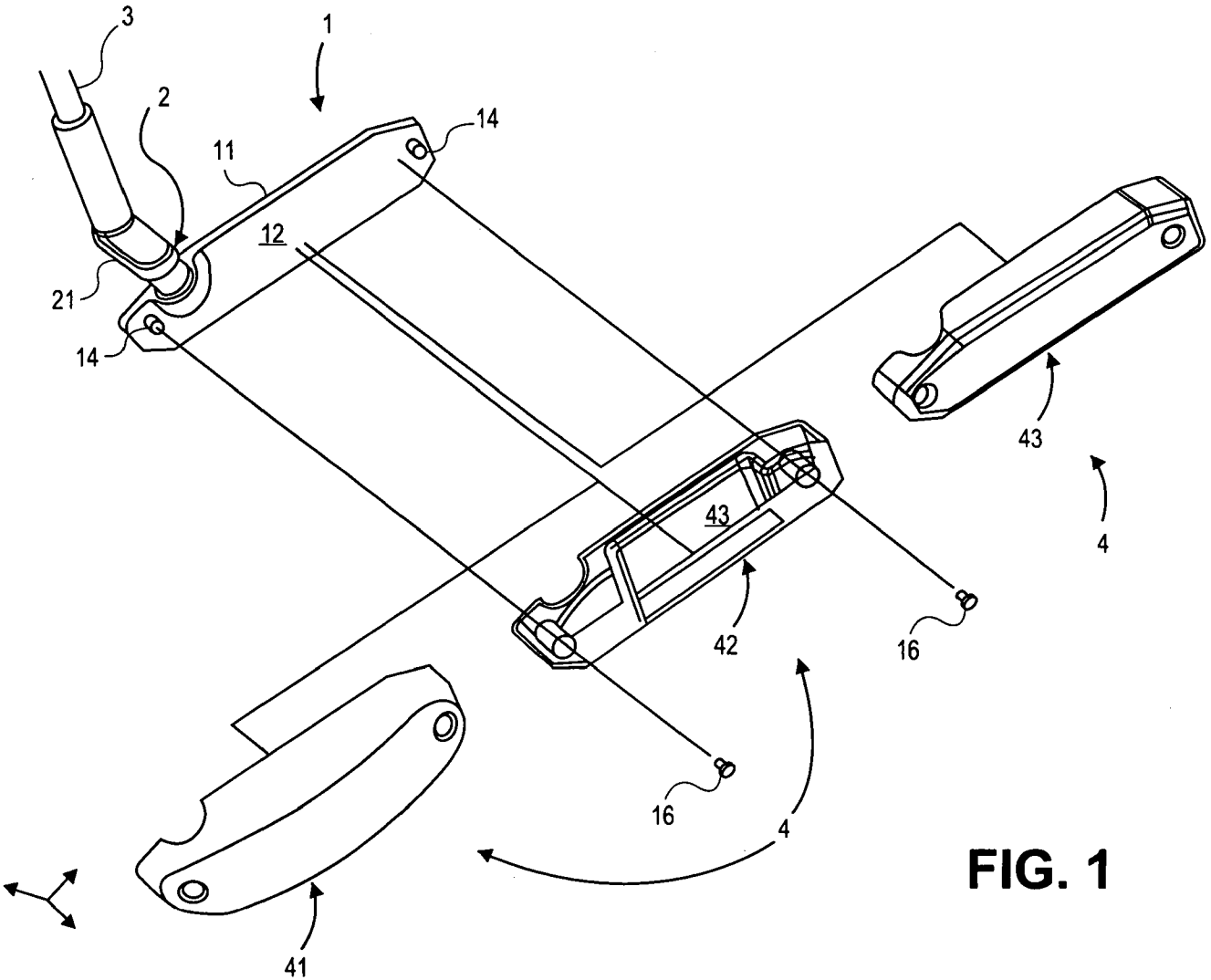
FIG. 1 is an exploded perspective illustration of a putter skeletal face with an attached angled shaft, the putter skeletal face having three different head covering bodies, any of these bodies being capable of attachment to the illustrated putter skeletal face.

Referring to FIG. 1, skeletal face 1 is here shown having ball contacting surface 11, interior attachment surface 12, and attachment points 14. Shaft attachment or hosel 2 fits to skeletal face 1 with offset 21 fixing skeletal face 1 with respect to shaft 3.

I show shaft 3 attached to shaft attachment or hosel 2. It will be understood that skeletal face 1 and be provided with or without the shaft 3 attached at the hosel. At present, I prefer the shaft 3 to be attached to the skeletal face 1. Replacement and removal of such shafts is well known in the art.

Head covering bodies 4 all having differing aerodynamic shapes and weighting are illustrated. Covering body 41 applies a mallet shape over interior attachment surface 12. Covering body 43 imparts a blade shape to the assembled club head. Finally waited covering body 42 applies respective masses of materials at the heel and toe with the central part of the covering body 42 defining cavity 43. It will be observed that screw fasteners 16 within threaded fastening points 14 enable the respective covering bodies 4 to be selectively fastened one at that time to interior attachment surface 12 of skeletal face 1.

It can thus be seen that in the case of the putter assembly here illustrated, a wide variety of specific shapes can be achieved. It can be further understood that with the respective covering bodies 41 to 43, feel and appearance of the club will be modified.

Figure 2:
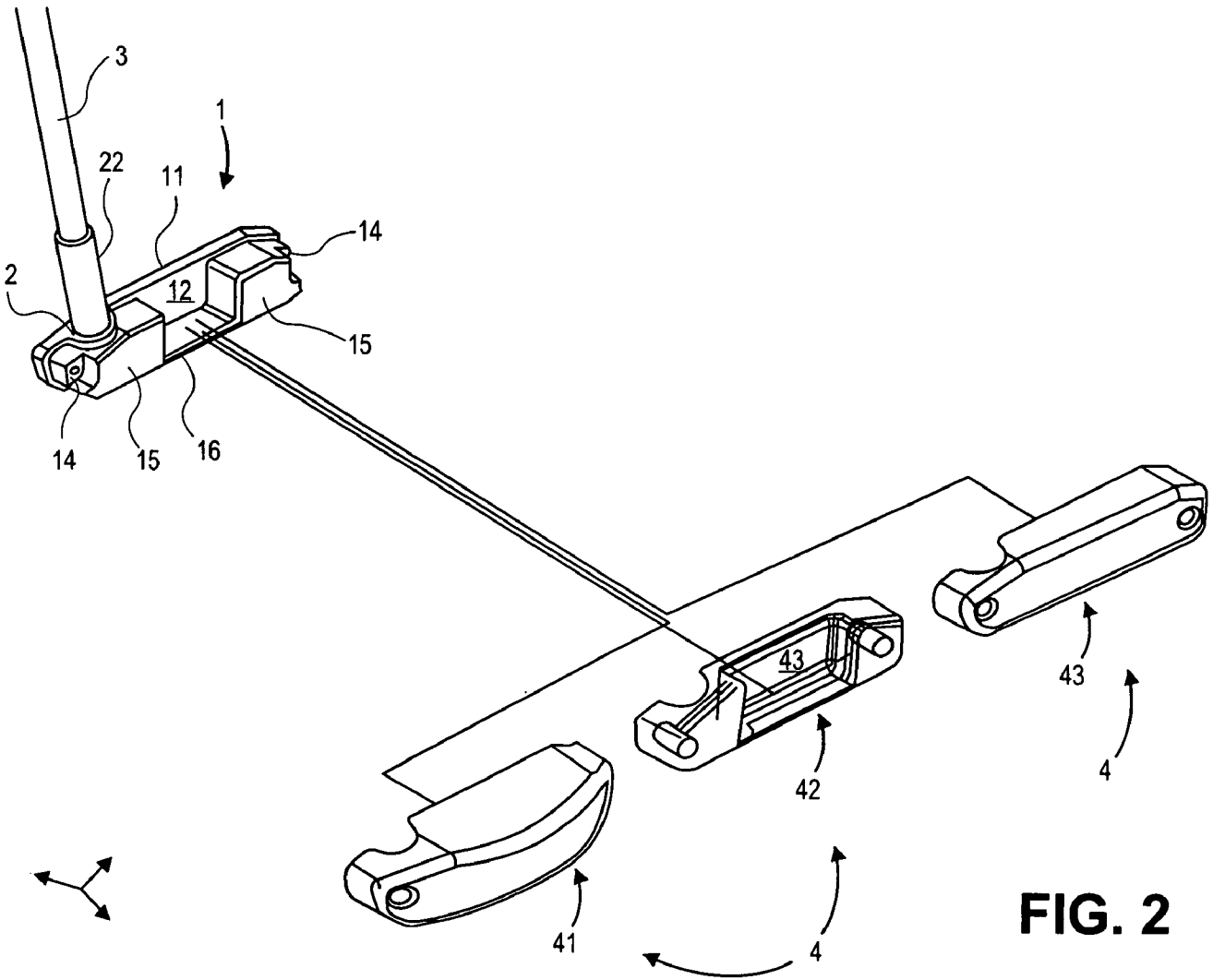
FIG. 2 is an exploded perspective illustration of a second putter skeletal face with an attached straight shaft, the second putter skeletal face having three different head covering bodies, any of these bodies being capable of attachment to the illustrated putter skeletal face with the bodies in this case providing the weighting.

FIG. 2 is a view similar to FIG. 1 with permanent weighting 15 and bottom surface 16 added at the base of skeletal face 1. Shaft 3 fits to shaft attachment points 2 with straight shaft attachment link 22.

Figure 3:
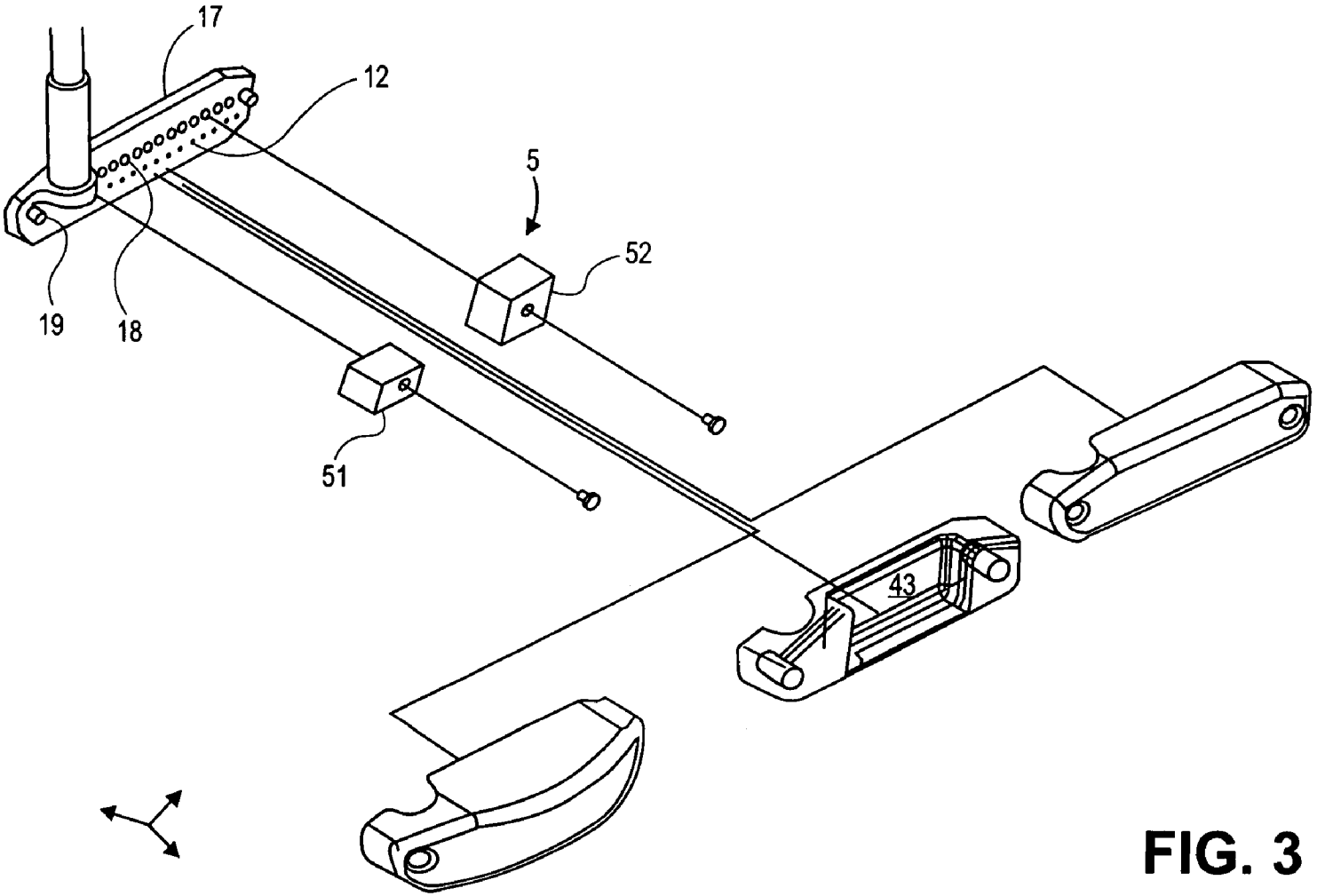
FIG. 3 is an exploded perspective illustration of a third putter skeletal face with an attached straight shaft, the third putter skeletal face having three different head covering bodies, any of these bodies being capable of attachment to the illustrated putter skeletal face and further illustrating the attachment of weights at the skeletal face for enclosure by the selected head covering body.

FIG. 3 illustrates alternate shaft skeletal face 17 having interior attachment surface 12 defining a matrix of attachment points 18, 19. As illustrated in FIG. 3, interior attachment surface weights 5 are shown being attached. It will be noted that weight 51 is smaller than weight 52; it is possible for the weights 51, 52 to be moved to numerous locations on interior attachment surface 12. Utilizing only the skeletal face 17 and the respective head covering bodies 41, 42, and 43, a putter head having multitudinous weighting variation can be created. By repeated disassembly, weight movement, and reassembly putter weighting can be accommodated over a wide range.

Figure 4:
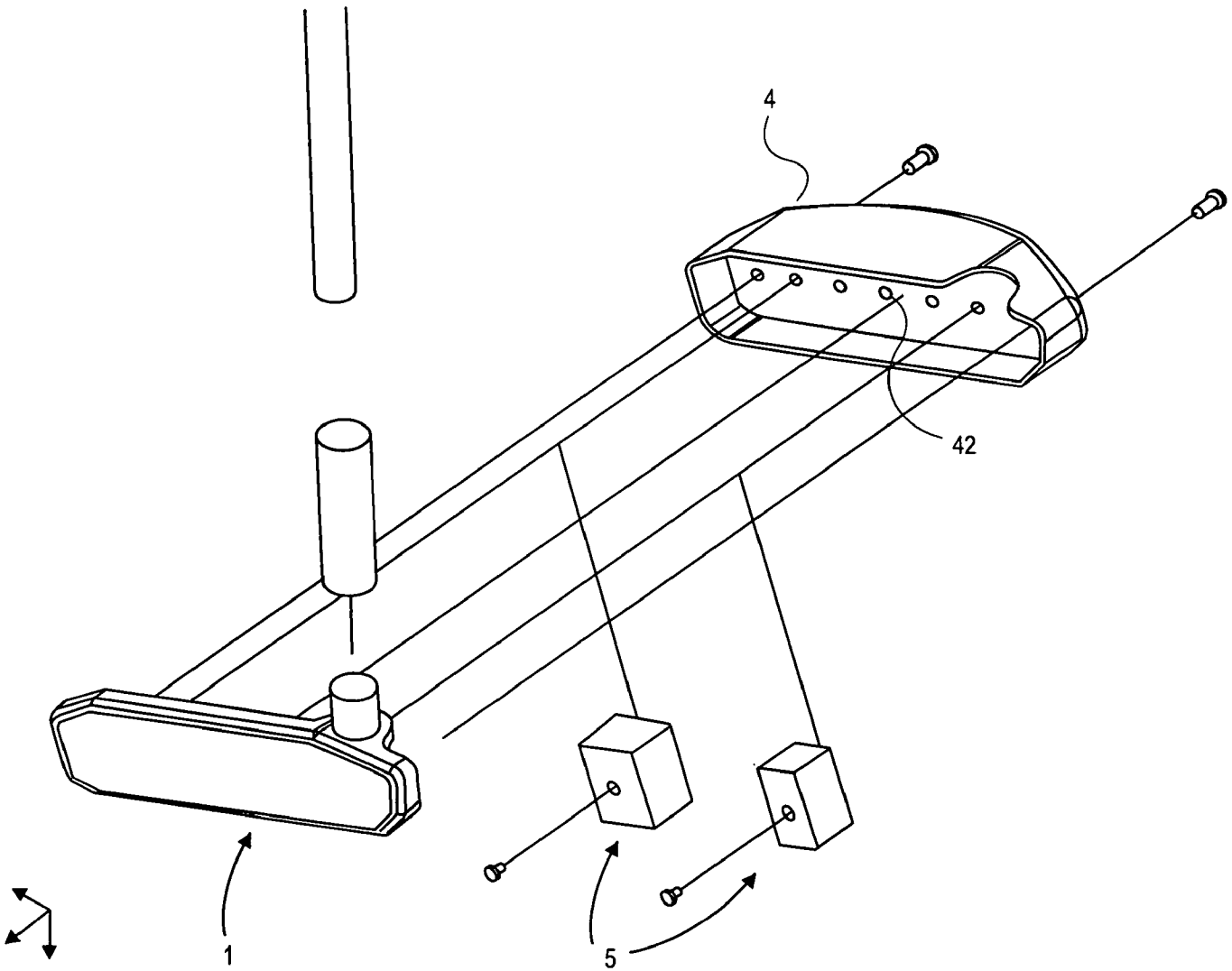
FIG. 4 is an exploded perspective illustration of a forth putter skeletal face with an alternate attached straight shaft having a single head covering body, the single head covering body adapted for the attachment of weights at the inside of the head covering body.

FIG. 4 illustrates skeletal face 1 with head covering body 4 being configured on the interior thereof with a matrix of weight attachment points 42. This time, weights 5 fastening interior of head covering body 4. Again, individual weighting of the putter head illustrated is widely variable.

Figure 5:
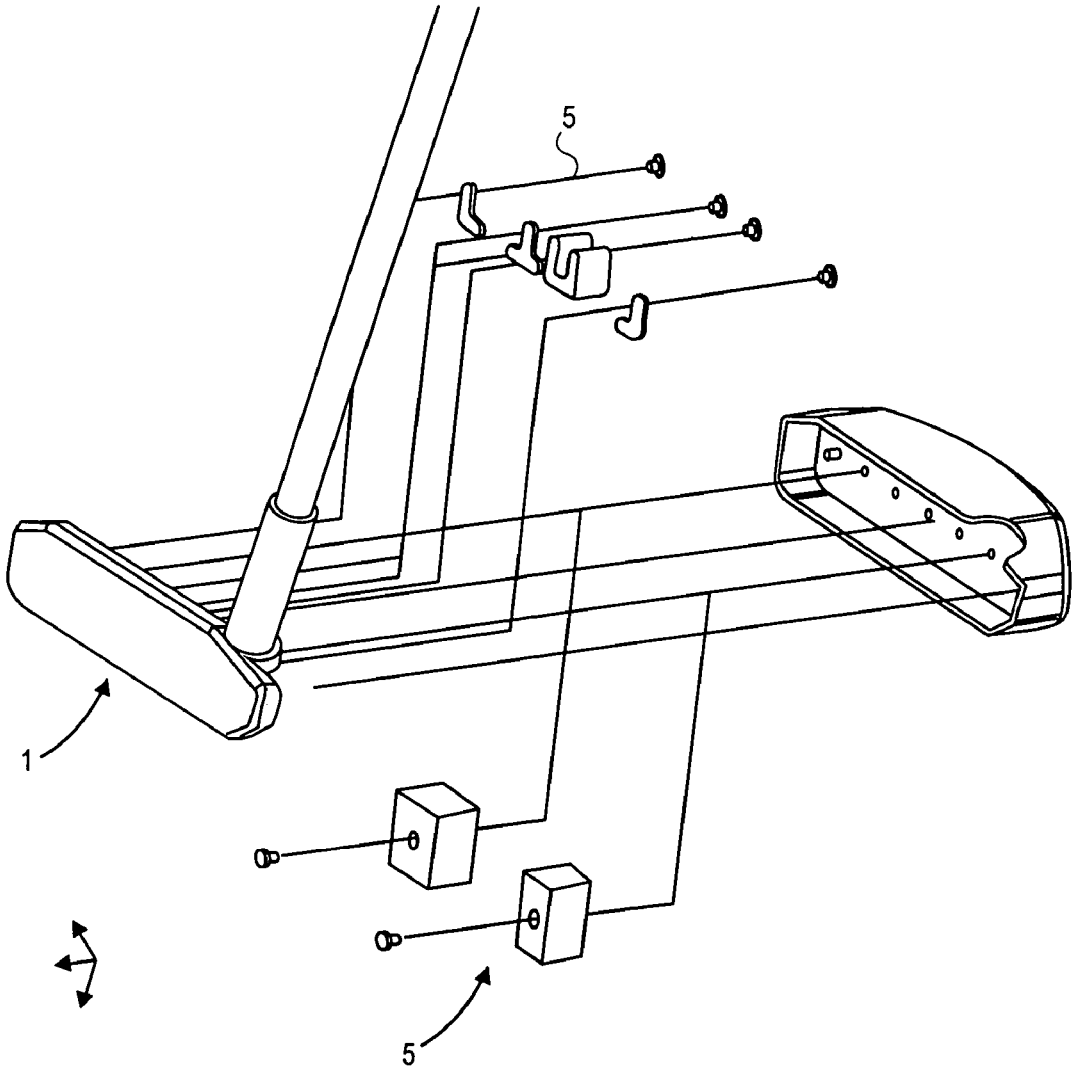
FIG. 5 is an exploded perspective view similar to FIGS. 3 and 4 illustrating weighting being placed on the reverse side of the skeletal face and the interior of the head covering body.

Preferring to FIG. 5, skeletal head 1 with a matrix of fastening points on the interior attachment surface 12 is shown accommodating respective weights 5, each weight having a fastening screw. Further, head covering body 4 again defines a matrix of fastening points 41 to accommodate weights 5. By the expedient of fastening the respective weights 5 to both interior attachment surface 12 of skeletal face 1 and the interior of head covering body 4, weighting of the club is individually adjustable.

Figure 6:
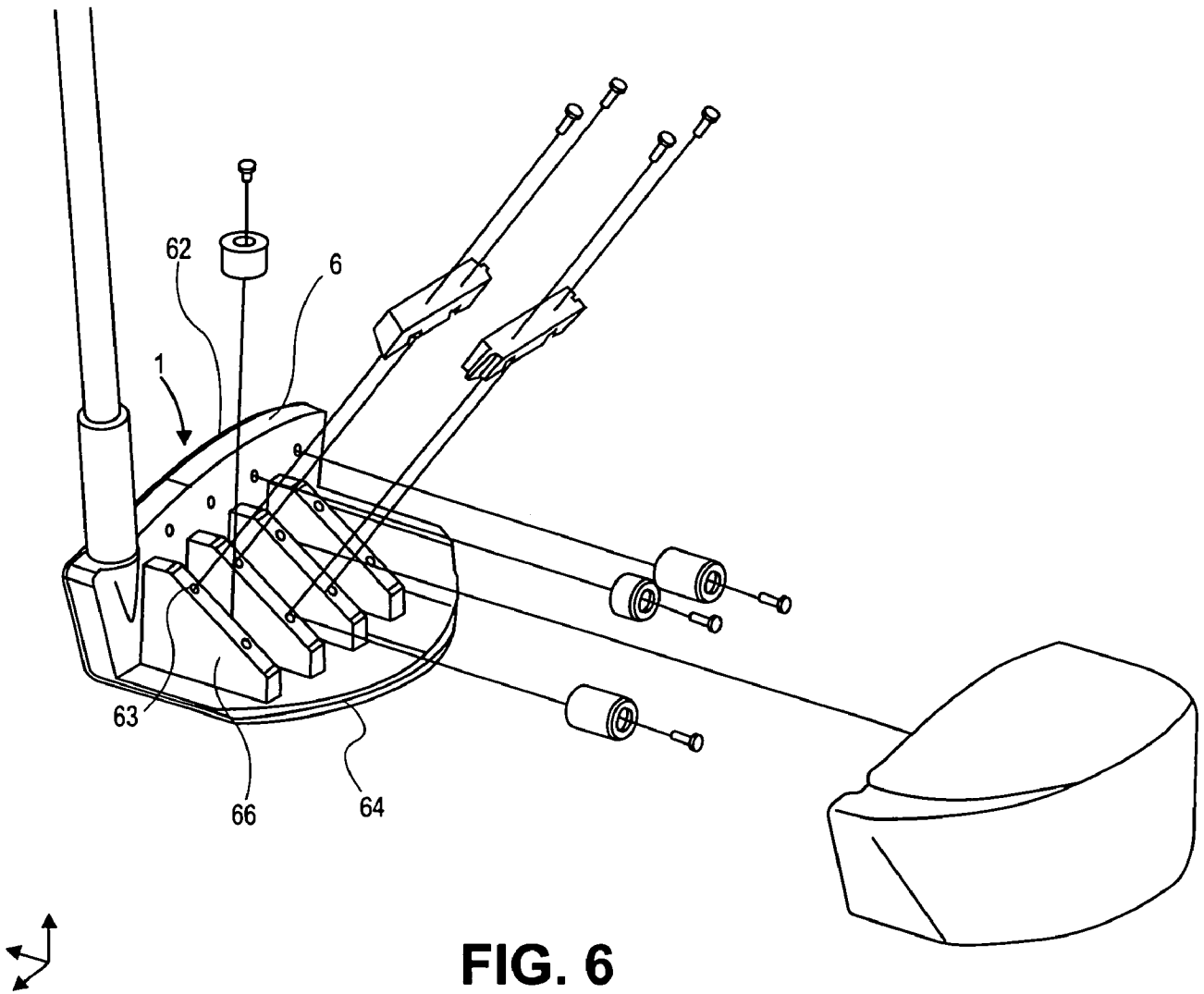
FIG. 6 is a perspective view of a skeletal face incorporated to the head of the driver illustrating weight placement to the reverse side of the skeletal face, the bottom side of the skeletal face, and bracing plates of the skeletal face extending between the backside of the ball impacting surface and the bottom of the driver or wood.

Referring to FIG. 6, this invention is shown incorporated to a driver. For the illustrated driver, skeletal head 1 includes blade surface 6 having ball driving surface 62 and the rear attachment surface 63. A driver bottom surface 64 aches and substantially parallel and to the rear of blade surface 6. Triangular reinforcement plates 66 reinforce skeletal head 1 between blade surface 6 and driver bottom surface 64. Fastening of weights 5 is illustrated to three respective surfaces. First, attachment of weights 5 occurs and rear attachment surface 63. Second, triangular reinforcement plates 66 are configured with attachment points for weights 5. Finally, driver bottom surface 64 exposes fastening points for placing weights 5 between the respective triangular reinforcement plates 66 on the top side of driver bottom surface 64. Weights may be attached to the covering body.

Figure 7:
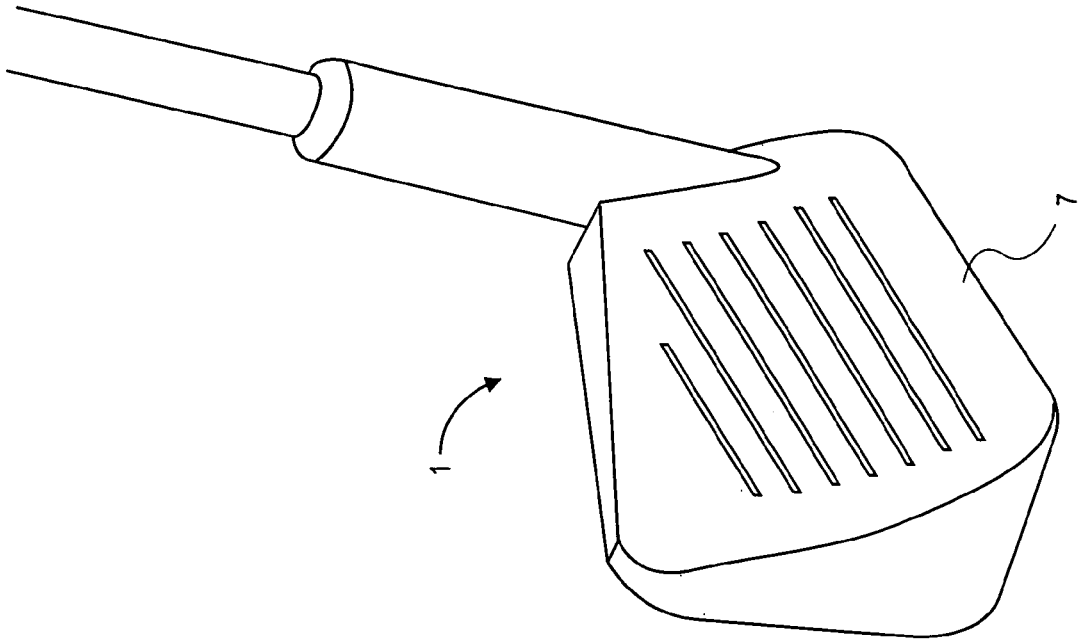
FIG. 7 is a perspective view of a skeletal face incorporated to the head of an iron having a rear cover illustrating weight placement to the rear cover of the iron.
Figure 7:
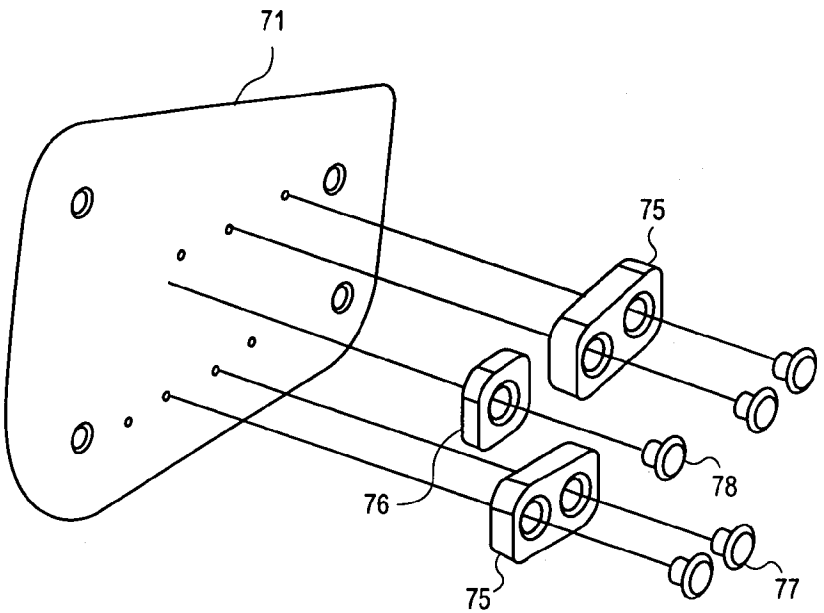

Referring to FIG. 7, skeletal head 1 includes blade surface 7, this time incorporated to a skeletal head that will become an iron. As before, skeletal head 1 is hollow on the reverse side from blade surface 7. Rear cover 71 is provided. To this rear cover 71, there are fastened two weights 75 and one smaller weight 76. Screws 77, 78 secure the weights 75, 76 to the inside of rear cover 71. As before, once attachment has occurred, rear cover 71 is conventionally fastened over skeletal face 1.

Figure 8:
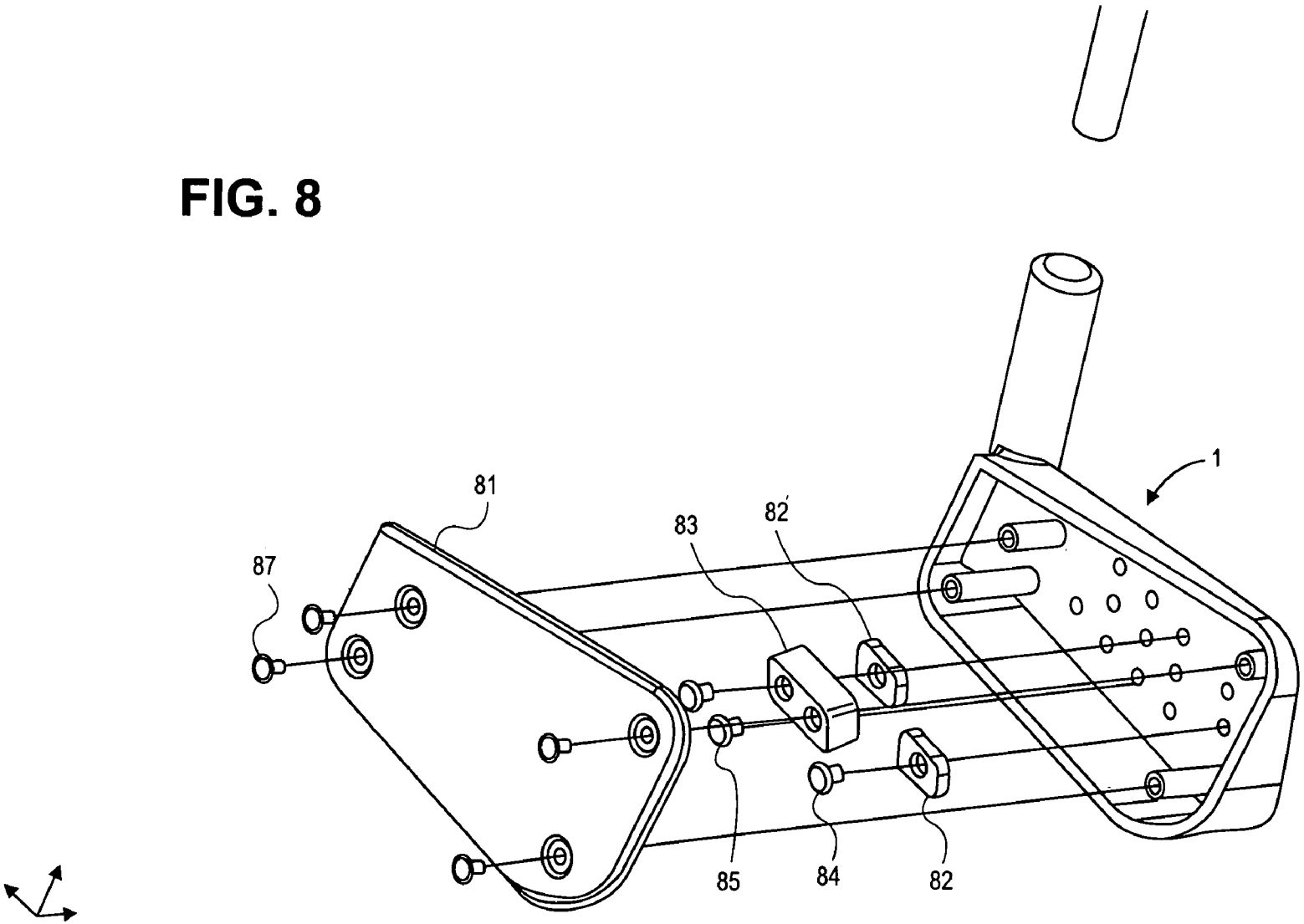
FIG. 8 is a perspective view of a skeletal face incorporated to the head of an iron with a rear cover illustrating weight placement to the side of the skeletal face away from the ball.

FIG. 8 also illustrates the assembly of an iron. Skeletal face 1 includes weights 82, 83 fastened to the inside of the skeletal face by respective screws 84, 85. Once the respective weights 82, 83 are fastened in place, closure of rear cover 81 occurs by screws 87 to enclose the otherwise hollow skeletal face 1. A customized iron results.

Figure 9:
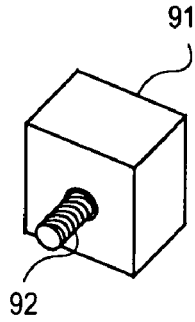
FIG. 9 is a perspective view of a weight having a screw intregally attached to the weight.

Referring to the detail of FIG. 9, weight 91 is illustrated having screw 92 intregally attached. In the illustrated case, screw 92 constitutes a male protuberance from the weight. The reader will realize that the protuberance could as well be from the face to which the weight fastens.

Figure 10:
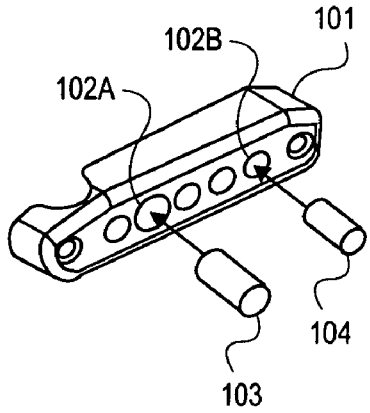
FIG. 10 illustrates a detachable head having a matrix of holes with two of the holes being filled with weight retaining resin and weights for retention in the holes by the resin; and, FIG. 11 illustrates a putter with weights having attachment to the rear face surface by Velcro tape.

Referring to FIG. 10, detachable head 101 for fastening to face 100 is illustrated having matrix of holes 102. In the case of holes 102*a* and 102*b*, the application of a retaining glue, such as an epoxy and resin, is shown with weights 103, 104 of different size being fitted to the holes 102*a* and 102*b*.

Figure 11:
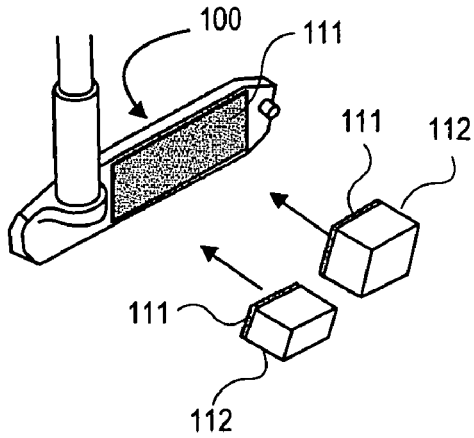

Referring to FIG. 11, a putter is illustrated having the reverse side 114 of the ball striking face 110 covered with Velcro tape 111. Weights 112 are shown placed and held to the reverse side 114 of the but all striking face 110. Since putters have considerably reduced dynamics, it has been found that fastening of weights by Velcro tape is sufficient.

Having set forth exemplary portions of golf clubs constructed with this invention, comment about the versatility and utility of the resultant golf club head can be made. It is then previously emphasized that each golfer's swing is a unique product of his physiology and psychology. Furthermore, the golf swing is not symmetric to the human body; it occurs to one side of the human body in a motion which is a repeatable but with varying force. Into this environment, we introduce the club head disclosed. As can be seen, the weight, appearance, feel, and performance can literally be altered on an individual basis. By the expedient of providing a retailer with an inventory of skeletal faces, head covering bodies, weights, shafts, and shaft attachments and infinitely variable golf club can be designed with the assistance of the retailer or by the golfer. With the disclosure herein, a golf professional can individually tailor a club uniquely to the amateur.

What is claimed is:

1. A process of individually tailoring a golf club to a golfer comprising the steps of:

providing a plurality of skeletal faces for a particular class of club chosen from the group consisting of a putter, an iron and a driver, each face comprising a unitary piece defining a point for shaft attachment, a surface for impacting a golf ball, and a surface with a plurality of attachment points;

providing a plurality of head covering bodies for covering each skeletal face away from the surface for impacting a golf ball, differing head covering bodies providing differing head shape cooperatively with differing skeletal faces to which the head covering bodies are attached;

providing a plurality of weights for attachment to either to the skeletal face or head covering bodies for individually weighting and assembling a golf club;

providing at least one shaft for attachment to the skeletal face;

selecting a skeletal face with the desired surface for impacting a golf ball;

selecting a head covering body for fastening to the skeletal face at the attachment surface for imparting desired club shape to the surface for impacting the ball;

fastening one or more weights to the golf club from the group including the skeletal face and the head covering body to impart club shape to the surface for impacting the ball;

after the fastening step, fastening the head covering body to the skeletal face to cover the one or more weights between the skeletal face and the head covering body; and, fastening a shaft to the skeletal face to provide an individually tailored golf club.

2. The process of individually tailoring a golf club to a golfer according to claim 1 and including the further steps of:

the provided skeletal face defines a putter face; and, the provided head covering body defines a putter body.

3. The process of individually tailoring a golf club to a golfer according to claim 2 and including the further steps of:

providing hook and loop tape fastening for weights between the putter face and putter body.

4. The process of individually tailoring a golf club to a golfer according to claim 2 and including the further steps of:

providing a matrix of holes in the head covering body to receive individual weights.

5. The process of individually tailoring a golf club to a golfer according to claim 1 and including the further steps of:

the provided skeletal face defines a driver face; and, the provided head covering body defines a driver body.

6. The process of individually tailoring a golf club to a golfer according to claim 1 and including the further steps of:

the provided skeletal face defines an iron face; and, the provided head covering body defines an iron body.

7. The process of individually tailoring a golf club to a golfer according to claim 5 and including the further steps of:

the provided skeletal face defining a driver face is provided with a ball contacting surface, a bottom surface, and triangular reinforcing members extending there between.

8. An individually adjustable golf club comprising:

a skeletal face for a particular class of club chosen from the group consisting of a putter, an iron and a driver, the skeletal face comprising a unitary piece defining a point for shaft attachment, a surface for impacting a golf ball of variable size, and a surface with plurality of attachment points;

a head covering body for covering the skeletal face away from the surface for impacting a golf ball;

a plurality of weights for attachment to either the skeletal face or head covering body for individually weighting and applying moment to a golf club;

a shaft for attachment to the skeletal face;

the head covering body fastened to the skeletal face at the attachment surface;

one or more weights fastened to the golf club from the group including the skeletal face and the head covering body, the head covering body being joined to the skeletal face to cover the one or more weights between the skeletal face and the head covering body to apply individual weight and moment to a golf club; and, one shaft attached to the skeletal face to provide an individually tailored golf club;

whereby a single club individually adjusted to a golfer is assembled.

9. The individually adjustable golf club according to claim 8 comprising:

the golf club is a puffer.

10. The individually adjustable golf club according to claim 8 comprising:

the golf club is a driver.

11. The individually adjustable golf club according to claim 8 comprising:

the provided skeletal face defines an iron.

12. The individually adjustable golf club according to claim 8 comprising:

providing weights with male protuberances for fastening to the skeletal face or the covering body.

13. A process of individually tailoring a golf club to a golfer comprising the steps of:

providing a skeletal face for a particular class of club chosen from the group consisting of a putter, an iron and a driver, each skeletal face comprising a unitary piece defining a point for shaft attachment, a surface for impacting a golf ball, and a surface with plurality of attachment points, the skeletal face selected for the shape of the surface for impacting the ball;

providing a plurality of head covering bodies for covering the skeletal face away from the surface for impacting a golf ball, differing head covering bodies providing differing head shapes cooperatively joined with differing skeletal faces to which the head covering bodies are attached;

providing a plurality of weights for fastening to the surface with a plurality of attachment points on the head covering bodies to provide weight and moment to the golf club; providing at least one shaft for attachment to the skeletal face;

selecting a head covering body for fastening to the skeletal face at the attachment surface;

fastening weights to the skeletal face or head covering body to provide desired weight and moment to the club head;

fastening the head covering body to the skeletal face to customize the golf club to the golfer; and, fastening a shaft to the skeletal face to provide an individually tailored golf club.

14. The individually adjustable golf club according to claim 8 comprising:

providing a plurality of skeletal faces.

15. The individually adjustable golf club according to claim 8 comprising:

providing a plurality of head covering bodies.

16. The individually adjustable golf club according to claim 15 comprising:

differing head covering bodies providing a differing golf club head shape.

17. The individually adjustable golf club according to claim 16 whereby the differing head covering bodies provide differing golf club head shapes cooperatively with the skeletal face.

18. The individually adjustable golf club according to claim 15 comprising:

differing head covering bodies providing a differing golf club head appearance.

19. The individually adjustable golf club according to claim 15 comprising:

differing head covering bodies providing differing golf club head weighting.

* * * * *

UNITED STATES PATENT AND TRADEMARK OFFICE

CERTIFICATE OF CORRECTION

PATENT NO. : 7,108,611 B2
APPLICATION NO. : 10/741311
DATED : September 19, 2006
INVENTOR(S) : Steve MacIlraith It is certified that error appears in the above-identified patent and that said Letters Patent is hereby corrected as shown below:

In column 6, line 40, claim 1, the word "to" at the end of the line should be deleted.

In column 7, line 52, the word "puffer" should be deleted and the word --putter-- should be added in its place.

Signed and Sealed this

Twenty-ninth Day of May, 2007

JON W. DUDAS
*Director of the United States Patent and Trademark Office*